US008999233B2

(12) United States Patent
Baker

(10) Patent No.: US 8,999,233 B2
(45) Date of Patent: Apr. 7, 2015

(54) NANOSTRUCTURED MN-AL PERMANENT MAGNETS AND METHODS OF PRODUCING SAME

(75) Inventor: Ian Baker, Etna, NH (US)

(73) Assignee: The Trustees of Dartmouth College, Hanover, NH (US)

( * ) Notice: Subject to any disclaimer, the term of this patent is extended or adjusted under 35 U.S.C. 154(b) by 228 days.

(21) Appl. No.: 13/328,903

(22) Filed: Dec. 16, 2011

(65) Prior Publication Data

US 2012/0090740 A1 Apr. 19, 2012

Related U.S. Application Data

(63) Continuation-in-part of application No. 12/089,876, filed as application No. PCT/US2006/041790 on Oct. 27, 2006, application No. 13/328,903, which is a continuation-in-part of application No. 13/164,495, filed on Jun. 20, 2011.

(60) Provisional application No. 60/730,697, filed on Oct. 27, 2005.

(51) Int. Cl.

| | |
|---|---|
| ***C22F 1/00*** | (2006.01) |
| ***C22F 1/16*** | (2006.01) |
| ***H01F 1/047*** | (2006.01) |
| *C21D 1/00* | (2006.01) |
| *H01F 1/057* | (2006.01) |

(52) U.S. Cl.
CPC *C22F 1/16* (2013.01); *H01F 1/047* (2013.01); *H01F 1/0579* (2013.01)

(58) Field of Classification Search
CPC ..... C22F 1/16; H01F 1/047; H01F 1/0579
USPC ..... 148/314, 559; 420/591
See application file for complete search history.

(56) References Cited

U.S. PATENT DOCUMENTS

| | | | |
|---|---|---|---|
| 3,447,203 | A | 6/1969 | Campbell |
| 4,042,429 | A | 8/1977 | Kojima et al. |

(Continued)

FOREIGN PATENT DOCUMENTS

| | | | |
|---|---|---|---|
| DE | 2452862 | A1 | 5/1976 |
| JP | 07011301 | A | 1/1995 |

(Continued)

OTHER PUBLICATIONS

Crew et al. "MnAl and MnAlC Permanent Magnets Produced by Mechanical Alloying", Scripta Metallurgica et Materialia, 32 (3), 315-318, 1995.*

(Continued)

*Primary Examiner* — Rebecca Lee
(74) *Attorney, Agent, or Firm* — Lathrop & Gage LLP

(57) ABSTRACT

Nanostructured Mn—Al, Mn—Al—C permanent magnets are disclosed. The magnets have high coercivities (about 4.8 kOe and 5.2 kOe) and high magnetization values. An intermetallic composition includes a ternary transition metal modified manganese aluminum alloy Mn—Al—Fe, Mn—Al—Ni, or Mn—Al—Co having at least about 80% of a magnetic τ phase and permanent magnetic properties. The alloy may have a saturation magnetization value of at least 96 emu/g with approximately 5% ternary transition metal replacing Al. The alloy may also have a saturation magnetization value of at least 105 emu/g with 10% ternary transition metal replacing Al.

6 Claims, 10 Drawing Sheets

(56) References Cited

U.S. PATENT DOCUMENTS

| | | | |
|---|---|---|---|
| 4,133,703 | A | 1/1979 | Kojima et al. |
| 4,342,608 | A | 8/1982 | Willens |
| 4,404,046 | A | 9/1983 | Sakamoto et al. |
| 4,443,276 | A | 4/1984 | Sanai et al. |
| 5,534,080 | A | 7/1996 | Kuo et al. |
| 7,924,607 | B2 | 4/2011 | Yoshikawa et al. |
| 2006/0278308 | A1 | 12/2006 | Shankar et al. |
| 2007/0131013 | A1 | 6/2007 | Segal |
| 2010/0218858 | A1 | 9/2010 | Baker et al. |
| 2012/0003114 | A1 | 1/2012 | Baker et al. |

FOREIGN PATENT DOCUMENTS

| | | | |
|---|---|---|---|
| JP | 2002356703 | A | 12/2002 |
| KR | 10-2011-0035293 | A | 4/2011 |

OTHER PUBLICATIONS

Morisako et al. "Crystal structure and magnetic properties of Mn-Al-Ni films prepared by sputtering", J. Appl. Phys. 67(9), 1990, 5655-5657.*

Wang et al. "Structure and Magnetic Properties of MnAl/α-Fe Nanocomposite Powders Prepared by High-energy Ball Milling", Advanced Materials Research vols. 287-290, 2001, 1492-1495.*

Response to Office Action in related U.S. Appl. No. 12/089,876, dated Mar. 28, 2013, 52 pages with Appendix.

Office Action issued in related U.S. Appl. No. 12/089,876, dated Apr. 11, 2013, 20 pages.

Morisako, et al. "Synthesis of Ferromagnetic T Phase of Mn-Al Films by Sputtering" J.Appl. Phys. 61(8), 1987, 4281-4283.

Ermakov, et al. "Magnetization Reversal Process" IEEE Transactions on Magnetics, 24(2), 1988, 1924-1926.

Zeng, Q, et al. "Structural and Magnetic Properties of Nanostructured Mn-Al-C Magnetic Materials" Journal of Magnetism and Magnetic Materials, vol. 308, pp. 214-226, 2007.

Fazakas, E., et al. "Preparation of Nanocrystalline Mn-Al-C Magnets by Melt Spinning and Subsequent Heat Treatments" Journal of Alloys and Compounds 434-435, pp. 611-613, 2007.

Zeng, Qi, et al. Nanostructured Mn-Al Permanent Magnets Produced by Mechanical Milling, Journal of Applied Physics, 99, 08E902, 2006.

Saito, Tetsuji, "Magnetic Properties of Mn-Al System Alloys Produced by Mechanical Alloying" Journal of Applied Physics, vol. 93, No. 10, pp. 8686-8688, May 15, 2003.

Kim, Kyu-Jin, et al. "Ferromagnetic a-Mn-Type Mn-Al Alloys Produced by Mechanical Alloying" Journal of Alloys and Compounds, 217, pp. 48-51, 1995.

International Search Report and Written Opinion issued in related PCT Patent Application Serial No. PCT/US2006/041790, dated Jul. 2, 2008, 18 pages.

Morisako, et al. "Crystal structure and magnetic properties of Mn-Al-Ni films prepared by sputtering," J. Appl. Phys. 67 (9), 1990, 5655-5657.

Machine Translation of DE 245286, 1976.

Select File History of related U.S. Appl. No. 13/164,495, dated Oct. 27, 2011 to Mar. 15, 2012, 53 pages.

Machine Translation of JP2002356703, 2002.

International Search Report and Written Opinion issued in related PCT Patent Application Serial No. PCT/US2012/029812, dated Sep. 5, 2012, 9 pages.

Select File History of Related U.S. Appl. No. 12/089,876 dated Sep. 6, 2011 through Mar. 15, 2012, 43 pages.

Response to Office Action in U.S. Appl. No. 12/089,876 dated Jul. 13, 2012, 8 pages.

Office Action issued in U.S. Appl. No. 12/089,876 dated Nov. 28, 2012, 17 pages.

Response to Office Action in U.S. Appl. No. 13/164,495, dated Sep. 12, 2012, 12 pages.

Suryanarayana et al., "Nanocrystalline materials-Current research and future directions," Hyperfine Interactions 130, , 5-44, 2000.

* cited by examiner

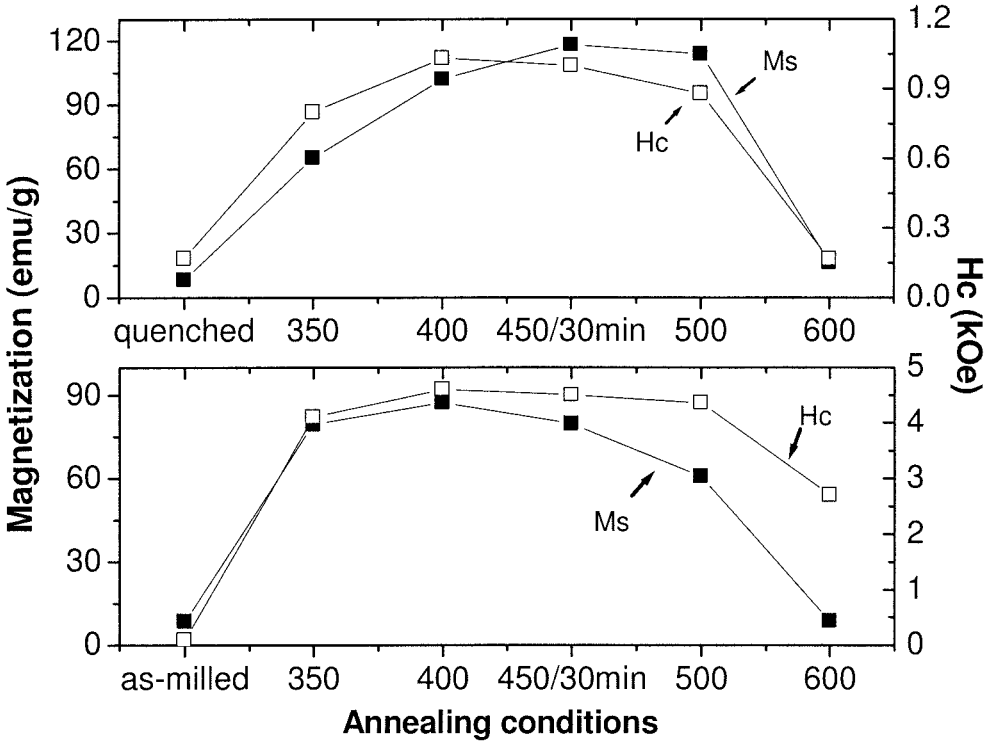
FIG. 6
FIG. 7
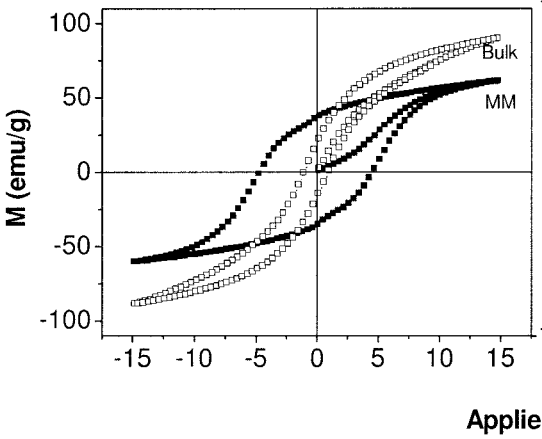
FIG. 8
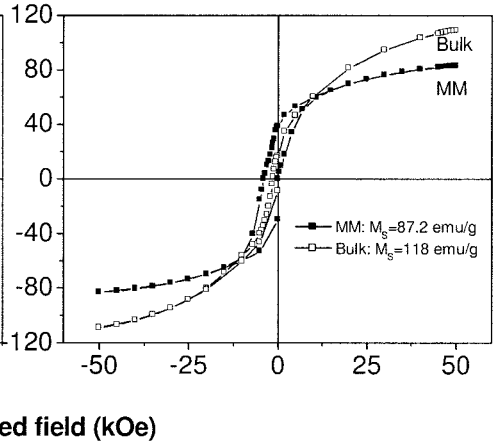
FIG. 9

NANOSTRUCTURED MN-AL PERMANENT MAGNETS AND METHODS OF PRODUCING SAME

RELATED APPLICATIONS

This application is a continuation in part of U.S. patent application Ser. No. 12/089,876 or PCT Application No. PCT/US06/417 90, filed on Oct. 27, 2006, which claims priority to U.S. patent application Ser. No. 60/730,697, filed Oct. 27, 2005, which is incorporated by reference herein. This application is also a continuation in part of U.S. patent application Ser. No. 13/164,495, filed Jun. 20, 2011, which is incorporated by reference herein.

GOVERNMENT INTERESTS

This invention was made with government support under contract number 60NANB2D0120 awarded by the National Institute of Standards and Technology (NIST). The government has certain rights in the invention.

BACKGROUND

Magnets may be broadly categorized as temporary or permanent. Temporary (soft) magnets become magnetized or demagnetized as a direct result of the presence or absence of an externally applied magnetic field. Temporary magnets are used, for example, to generate electricity and convert electrical energy into mechanical energy in motors and actuators. Permanent (hard) magnets remain magnetized when they are removed from an external field. Permanent magnets are used in a wide variety of devices including motors, magnetically levitated trains, MRI instruments, and data storage media for computerized devices.

High-performance permanent magnets, such as Sm—Co (coercivity $H_C$=10-20 kOe) and Nd—Fe—B ($H_C$=9-17.5 kOe), are generally intermetallic alloys made from rare earth elements and transition metals, such as cobalt. However, the high cost of rare earth elements and cobalt makes the widespread use of high-performance magnets commercially impractical. Less expensive magnets are more commonly used, but these magnets generally have lower coercivity $H_C$, i.e., their internal magnetization is more susceptible to alteration by nearby fields. For example, ferrites, which are predominantly iron oxides, are the cheapest and most popular magnets, but they have both low coercivities or coercive forces ranging from 1.6 to 3.4 kOe and low values of magnetization. Similarly, aluminum-nickel-cobalt ("Alnico") alloys which contain large amounts of nickel, cobalt, and iron, and small amounts of aluminum, copper, and titanium, have coercivity in the range of 0.6 to 1.4 kOe, which makes exposure to significant demagnetizing fields undesirable.

More recently, Mn—Al—C alloys have been produced by mechanical alloying processes. D. C. Crew, P. G. McCormick and R. Street, *Scripta Metall. Mater.,* 32(3), p. 315, (1995) and T. Saito, *J. Appl. Phys.,* 93(10), p. 8686, (2003) have shown that adding small amounts of carbon (e.g., about 2 atomic % or less) to certain Mn—Al alloys stabilizes the metastable τ phase and improves magnetic properties and ductility. Crew et al. (1995) produced $Mn_{70}Al_{30}$ weight % and $Mn_{70.7}Al_{28.2}C_{1.1}$ weight % alloys by consolidating ball milled powders, annealing at 1050° C. and then quenching, after which the materials were no longer nanocrystalline. The resulting alloys had grain sizes of about 300-500 nm and exhibited coercivities, $H_C$, of 1.4 kOe and 3.4 kOe, respectively. Saito (2003), produced mechanically alloyed $Mn_{70}Al_{30}$ weight % and $Mn_{70}Al_{29.5}C_{0.5}$ weight % alloys that had grain sizes of about 40-60 nm and coercivities of 250 Oe and 3.3 kOe, respectively. In this study, the low coercivities reflected the limited formation of the magnetic τ phase, which was determined to be 10% in $Mn_{70}Al_{30}$ and 40% in $M_{70}Al_{29.5}C_{0.5}$. K. Kim, K. Sumiyama and K. Suzuki, *J. Alloys Comp.,* 217, p. 48, (1995), produced MnAl alloys that were ball milled, but never annealed. The alloys displayed no hard magnetic properties, with a low $H_C$ of 130 Oe. These Mn—Al alloys are made from relatively inexpensive materials, but the low coercivities remain a problem.

SUMMARY

The subject matter of the present disclosure advances the art and overcomes the problems outlined above by providing nanostructured Mn—Al alloys and a method for their manufacture. Constituents of these alloys may be mechanically milled and heat-treated to form permanent room temperature magnets with high coercivities and relatively high saturation magnetization values.

In an embodiment, provided herein is an intermetallic composition including a ternary transition metal modified manganese aluminum alloy comprising at least about 80% of a magnetic τ phase and having permanent magnetic properties. Examples of the transition metals include, but are not limited to, iron, cobalt and nickel. In a particular embodiment, the manganese aluminum alloy has a macroscopic composition of $Mn_XAl_YT_Z$, where T is a ternary transition metal selected from a group consisting of iron, cobalt and nickel, X ranges from 50 atomic % to 60 atomic %, X+Y+Z=100 atomic %, and Z is equal or less than 10%. The manganese aluminum alloy can have a macroscopic composition of $Mn_{54}Al_YT_Z$, wherein Y ranges from 36-46 atomic %, and Z ranges from 0-10 atomic %. In an embodiment, the alloy includes approximately 54 atomic % manganese, approximately 41 atomic % aluminum, and approximately 5 atomic % ternary transition metal. In another embodiment, the permanent magnetic properties includes a saturation magnetization value of at least 96 emu/g. In still another embodiment, the alloy comprises approximately 54 atomic % manganese, approximately 36 atomic % aluminum, and approximately 10 atomic % ternary transition metal. The permanent magnetic properties can comprise a saturation magnetization value of at least 105 emu/g.

In another embodiment, a nanostructured manganese aluminum alloy includes at least about 80% of a magnetic τ phase and having a macroscopic composition of $Mn_XAl_YT_Z$, where T is a ternary transition metal selected from a group consisting of iron, cobalt and nickel, X ranges from 50 atomic % to 60 atomic %, X+Y+Z=100 atomic %, and Z is equal or less than 10%. In a particular embodiment, the manganese aluminum alloy has a macroscopic composition of $Mn_{54}Al_YT_Z$, where Y ranges from 36 atomic % to 46 atomic %, and Z ranges from 0 atomic % to 10 atomic %. The alloy can include approximately 54 atomic % manganese, approximately 41 atomic % aluminum, and approximately 5 atomic % ternary transition metal. The permanent magnetic properties can include a saturation magnetization value of at least about 96 emu/g. The alloy can include approximately 54 atomic % manganese, approximately 36 atomic % aluminum, and approximately 10 atomic % ternary transition metal. The permanent magnetic properties can include a saturation magnetization value of at least about 105 emu/g.

In an embodiment, a method of producing a ternary transition metal modified manganese aluminum alloy composition is provided. The method includes heating a mixture of Mn, Al and a ternary transition metal selected from the group consisting of iron, cobalt, and nickel to provide a substantially homogeneous solution. The method also includes quenching the substantially homogeneous solution to obtain a substantially homogeneous solid and reheating the solid to a diffusion temperature below the melting temperature of manganese. The method can further include quenching the reheated solid, crushing the quenched solid, and milling the crushed solid. The method can also include annealing the milled solid such that the composition is produced. In a particular embodiment, the manganese aluminum alloy has a macroscopic composition of Mn54AlYTZ, Y ranges from 36-46 atomic %, and Z ranges from 0-10 atomic %. The mixture of metals includes approximately 54 atomic % manganese, 41 atomic % aluminum, and 5 atomic % ternary transition metal. The mixture of metals includes approximately 54 atomic % manganese, 36 atomic % aluminum, and 10 atomic % ternary transition metal. The step of reheating includes reheating the solid to a temperature of 1150° C. for about 20 hours. The step of annealing includes annealing the milled solid at a temperature ranging from 350° C. to 600° C. for approximately 10-30 minutes. The ternary transition metal modified manganese aluminum alloy comprises $Mn_XAl_YT_Z$, T is the ternary transition metal, X ranges from 50 atomic % to 60 atomic %, X+Y+Z=100 atomic %, and Z is equal or less than 10%.

Additional embodiments and features are set forth in the description that follows, and will become apparent to those skilled in the art upon examination of the specification or may be learned by the practice of the invention. A further understanding of the nature and advantages of the present invention may be realized by reference to the remaining portions of the specification.

BRIEF DESCRIPTION OF THE DRAWINGS

FIG. 6 shows room temperature dependence of saturation magnetization and coercive field on annealing temperatures for bulk un-milled samples.

FIG. 7 shows room temperature dependence of saturation magnetization and coercive field on annealing temperatures for mechanically milled samples.

FIG. 8 shows room temperature hysteresis loops in a 15 kOe field for mechanically milled (MM) and bulk $Mn_{54}Al_{46}$ powders annealed at 400° C. for ten minutes.

FIG. 9 shows room temperature hysteresis loops in a 50 kOe field for mechanically milled (MM) and bulk $Mn_{54}Al_{46}$ powders annealed at 400° C. for ten minutes.

DETAILED DESCRIPTION

Figure 1:
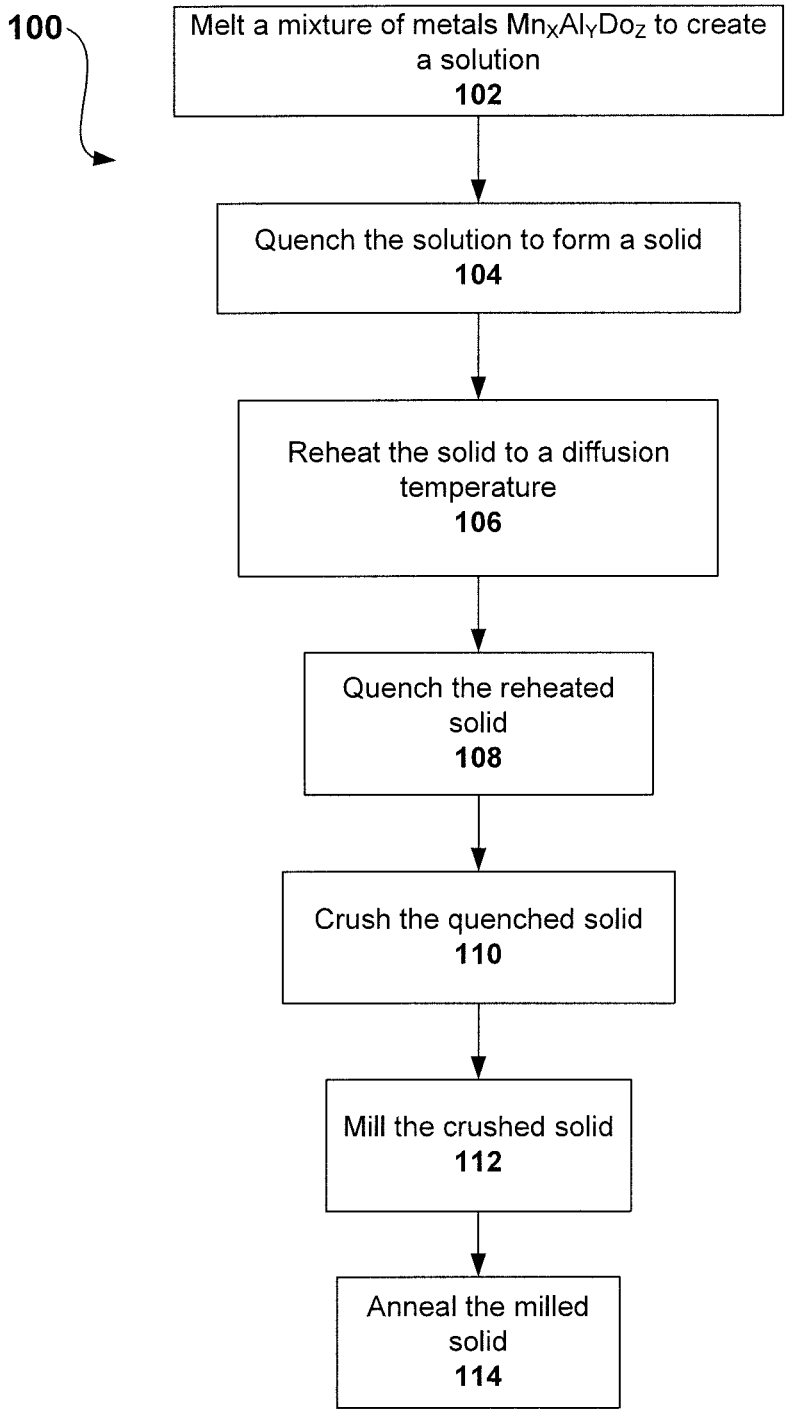
FIG. 1 is a flowchart illustrating a method of producing magnetic alloys according to one embodiment.

Methods for producing mechanically milled, nanostructured Mn—Al and Mn—Al—C alloys will now be shown and described. High room temperature coercivities and saturation magnetization values have been achieved for Mn—Al alloys that are produced by the presently described methods, and it has been shown that the addition of small amounts of carbon (e.g., about 3 atomic % or less) to Mn—Al alloys stabilizes the metastable τ phase and improves magnetic properties. It is also shown that a small amount of ternary transition metal, such as iron (Fe), cobalt (Co) and nickel (Ni), can be added to the metastable τ-MnAl phase to replace a portion of Al to form an alloy with the macroscopic composition of $Mn_XAl_YT_Z$. Such a method increases saturation magnetization of the metastable τ-MnAl phase.

The benefits of the nanostructured Mn—Al and Mn—Al—C permanent magnets include high coercivities (about 4.8 kOe and 5.2 kOe, respectively) and high saturation magnetization values. The benefits of the magnets also include relatively low cost and readily available raw material supplies compared to rare earth magnets.

Mechanically milled Mn—Al alloys possessing a nanostructured ferromagnetic τ phase, with $H_C$=4.8 kOe and $M_S$=87 emu/g at room temperature, were obtained by annealing $Mn_{54}Al_{46}$ powders at 400° C. for 10 minutes. The coercivity value of this alloy is the highest ever reported for Mn—Al materials. The amount of magnetic τ phase present in the annealed product is estimated from the saturation magnetization ($M_S$ of pure τ phase is about 110 emu/g) to be about 80%. In another embodiment, a Mn—Al—C alloy, $Mn_{51}Al_{46}C_3$, prepared by the same method displayed a coercivity that is the highest ever reported for Mn—Al—C materials, $H_C$=5.2 kOe.

The macroscopic formulas presented herein, e.g., $Mn_{54}Al_{46}$, pertain to the overall composition, but the materials have nanostructure or microstructure of localized phase variation (e.g., γ, β, and/or τ phases). As used herein, a "nanostructured" material is a bulk solid characterized by localized variation in composition and/or structure such that the localized variation contributes to the overall properties of the bulk material.

The large coercive forces observed are believed to result from small grains of the magnetic τ phase (about 30 nm) being magnetically isolated from one another. This lack of magnetic exchange coupling may result from non-magnetic phases (e.g., β, γ) inhibiting changes in the alloy's internal magnetization when an external magnetic field is applied (i.e., the non-magnetic phase(s) act as magnetic domain wall pinning sites).

The alloys disclosed herein are resistant to corrosion and may, for example, be used in applications currently utilizing known permanent magnets. In one embodiment, small particles or powders of the alloys may be produced in a resin or plastic bonded form according to known methods. The small grain size of the alloys may provide improved ductility relative to materials with larger grains.

To increase saturation magnetization of the metastable τ-MnAl phase, a small amount of ternary transition metal, such as iron (Fe), cobalt (Co) and nickel (Ni), is added to the metastable τ-MnAl phase to replace Al with the ternary transition metal to form the alloy with a macroscopic composition of $Mn_XAl_YT_Z$, where T is a ternary transition metal selected from a group consisting of iron, cobalt and nickel, X ranges from 50 atomic % to 60 atomic %, X+Y+Z=100 atomic %, Z is equal or less than 10%.

In one embodiment, the manganese aluminum alloy has a macroscopic composition of $Mn_{54}Al_YT_Z$, Y ranges from 36-46 atomic %, and Z ranges from 0-10 atomic %. For example, based upon available phase diagrams, up to 5 atomic % of Fe, Co or Ni can be dissolved in the ϵ phase of MnAl. In a particular embodiment, 5 atomic % Al in metastable τ-MnAl phase may be replaced by Fe, Co, or Ni to occupy the Al sublattice, which will increase the saturation magnetization $M_s$ by at least 10% for $Mn_{54}Al_{41}Fe_5$, $Mn_{54}Al_{41}Co_5$, or $Mn_{54}Al_{41}Ni_5$ for $Mn_{54}Al_{46}$. For example, the saturation magnetization may be increased to at least about 96 emu/g from 87 emu/g for $Mn_{54}Al_{46}$ The reason for this increase in $M_s$ is that the ternary transition metals Fe, Co, and Ni are magnetic while Al is non-magnetic.

In another embodiment, more Al may be replaced by a ternary transition metal such as Fe, Co, or Ni while still retaining the metastable τ phase, which would result further increase in $M_s$. About 10 atomic % Al may be replaced by Fe, Co, or Ni, which results in at least 20% increase in $M_s$. For example, the saturation magnetization may be increased to at least about 105 emu/g from 87 emu/g for $Mn_{54}Al_{46}$.

The limit of solubility of Fe, Co or Ni in the metastable τ-MnAl may depend upon difference of the atomic sizes of Fe, Co and Ni from Al, as Al has a smaller atomic number than Fe, Co or Ni so that it has a smaller atomic size than Fe, Co and Ni. Because Fe, Co and Ni have very close atomic numbers which are 26, 27 and 28, their solubility is expected to be similar.

FIG. 1 is a flowchart illustrating a method 100 of producing magnetic alloys according to one embodiment. In a first step 102, a mixture of metals $Mn_XAl_YDo_Z$, which may be in the form of ingots, powders, ribbons, pellets or the like, is melted to provide a liquid solution. In a second step 104, the liquid solution is quenched to form a solid solution. Steps 102 and 104 may be repeated to ensure that adequate mixing results in the formation of a substantially homogeneous solid solution. A "substantially homogeneous" solution has a uniform structure or composition throughout, such that in a randomized sampling of the solution at least 95% of the samples would have consistent compositions. In step 106, the substantially homogeneous solid solution is reheated to a diffusion temperature that is just below the melting temperature of the solid. The solid is held at the diffusion temperature for a period of time that is sufficient for the solid diffusion process to reach completion. For example, the solid may be held at the diffusion temperature for twenty hours. In step 108, the solid is quenched, e.g., with water, to halt the diffusion process, and isolate the solid without structural rearrangement that would otherwise occur in a slow cooling process. In steps 110 and 112, the quenched solid is crushed and milled to repeatedly fracture and cold weld the particles in order to form a nanostructured material. The milling is sufficient to cause a rupture of the crystals of the alloy as well as to allow sufficient interdiffusion between the elementary components. In step 114, the milled solid is annealed to ensure complete formation of the nanostructured magnetic alloy.

In the case of the metal alloy $Mn_XAl_YT_Z$, the alloy may be provided in the form of ingots, powders, ribbons, pellets or the like, and may be heated to melt manganese and aluminum, but the transition metal T (e.g. Fe, Co, or Ni) may still be in solid form. Then, the liquid solution including melted manganese and aluminum and transition metal in solid form is quenched to form a solid solution.

Production of $Mn_{54}Al_{46}$ $Mn_{54}Al_{46}$ alloy ingots were prepared by arc-melting stoichiometrically balanced quantities of Mn and Al in a water-cooled copper mold ($T_m$≈1250-1350° C.). The melted metallic solution was then heated until molten. Quenching was performed by allowing the alloy to rapidly cool in the copper mold to a temperature of about 30° C. in approximately 10 minutes. The ingots were flipped and melted a minimum of three times under argon to ensure mixing. The ingots were subsequently heated to and held at 1150° C. for 20 hours followed by water quenching to retain the ϵ phase. The ingots were then crushed and milled for eight hours in a hardened steel vial using a SPEX 8000 mill containing hardened steels balls with a ball-to-charge weight ratio of 10:1. The vials were sealed under argon to limit oxidation. Both the as-milled powders and the quenched bulk samples were annealed at temperatures from 350-600° C. for 10-30 minutes to produce the ferromagnetic τ phase.

The magnetic properties were measured at a room temperature of about 20° C. using a LakeShore 7300 vibrating sample magnetometer (VSM) under an external magnetic induction field of 15 kOe. Some samples were also measured with an Oxford superconducting quantum interference device (SQUID) magnetometer under a field of 50 kOe. Accuracy of the magnetic measurements is within ±2%. Therefore, magnetic data may be reported as "about" a particular value to account for ubiquitous sources of error (e.g., magnetic fields within or near the magnetometer and errors associated with weighing samples). Microstructural characterization was performed using a Siemens D5000 diffractometer with a Cu X-ray tube and a KeVex solid state detector set to record only Cu Kα X-rays.

Figures 2, 3, 4, 5:
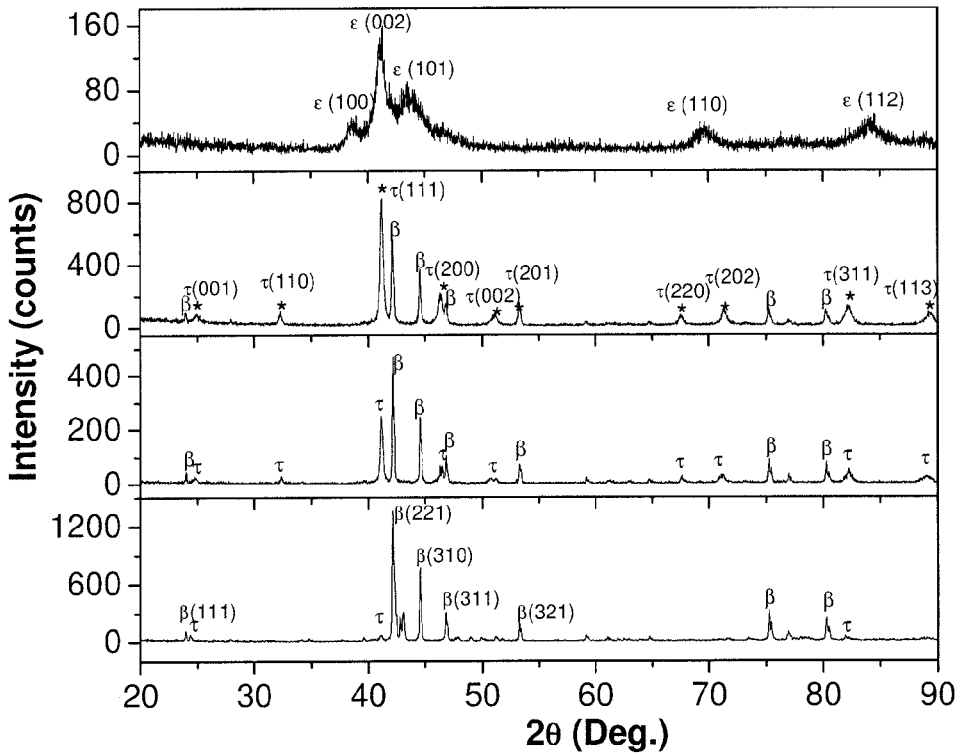
FIG. 2 shows an X-ray diffraction pattern of $Mn_{54}Al_{46}$ prior to annealing.
FIG. 3 shows an X-ray diffraction pattern of $Mn_{54}Al_{46}$ annealed at 400° C. for thirty minutes.
FIG. 4 shows an X-ray diffraction pattern of $Mn_{54}Al_{46}$ annealed at 500° C. for thirty minutes.
FIG. 5 shows an X-ray diffraction pattern of $Mn_{54}Al_{46}$ annealed at 600° C. for thirty minutes.

FIGS. 2-5 show X-ray diffraction patterns of $Mn_{54}Al_{46}$ annealed at various temperatures. X-ray diffraction patterns for as-milled alloys showed peaks corresponding to the ϵ phase of the MnAl alloy, where the ϵ phase has a crystal structure of hexagonal close packed (h.c.p). As shown in FIG. 2 the diffraction peaks were broad and of low intensity, indicative of a nanocrystalline grain structure. The grain size of the ϵ phase calculated from the (111) X-ray peak using the Scherrer formula was 8 nm. Annealing the as-milled sample of $Mn_{54}Al_{46}$ at 400° C. for 30 minutes caused the ϵ phase to transform to the τ phase which has a crystal structure of face centered tetragonal (f.c.t.). FIG. 3 shows peaks indicative of the τ phase marked by asterisks. The calculated τ phase grain size was about 27 nm, which is much smaller than that produced by conventional casting, grinding or extruding. Without being bound by theory, the smaller grain size appears to result from the τ phase forming from the nanocrystalline ϵ phase. Increasing the annealing temperature to 500° C. for 30 minutes caused decomposition of the τ phase, as shown in FIG. 4 by a decrease in intensity of the τ phase peaks. Annealing at 600° C. for 30 minutes resulted in a minimal presence of the τ phase in the final product, as shown in FIG. 5.

These results show that the improved magnetic performance may be related to small grain sizes, where the nanostructured ϵ phase material is transformed to the ferromagnetic τ phase at anneal conditions characterized by the 400° C. anneal which produced the results of FIG. 3. The effective temperature range for this anneal is between 300° C. and 600° C., and more preferably from 350° C. to 500° C., and most preferably from 350° C. to 450° C. The smaller grain sizes are facilitated by the milling that occurs just prior to the anneal.

FIGS. 6 and 7 show the sensitivity or dependence of saturation magnetization, $M_S$, and coercivity, $H_C$, upon annealing temperatures for both bulk (FIG. 6) and mechanically milled (FIG. 7) $Mn_{54}Al_{46}$. For bulk samples, the $M_S$ tends to increase with increasing annealing temperature from 300° C. to 500° C. The $M_S$ for mechanically milled $Mn_{54}Al_{46}$ increases from 350° C. to 400° C., then decreases with increasing annealing temperature from 400° C. to 600° C. This is consistent with the X-ray diffraction data (FIGS. 3-5) that showed the volume fraction of the magnetic τ phase decreasing with annealing temperatures above 400° C. The $H_C$ changes relatively little from 350° C. to 500° C. for mechanically milled samples. The optimal magnetic properties for mechanically milled samples, $H_C$=4.8 kOe, and $M_S$=87 emu/g, were obtained for $Mn_{54}Al_{46}$ powders annealed at 400° C. for 10 minutes. The coercivity value of the mechanically milled alloy is the highest reported to date for Mn—Al magnetically isotropic powders. In general, the $M_S$ obtained for annealed, mechanically milled samples was lower than that obtained in bulk samples, while the $H_C$ was higher, due to the small τ phase grain size.

FIGS. 8 and 9 show room temperature magnetic hysteresis loops for mechanically milled (solid squares) and bulk (open squares) $Mn_{54}Al_{46}$ powders annealed at 400° C. for 10 minutes. FIG. 8 shows hysteresis loops in a 15 kOe field. Coercivity is measured as the distance along the x-axis from the origin to the intersection of the curve with the x-axis. It can be seen that the mechanically milled sample has a much larger coercivity (about 5 kOe) than the bulk sample (about 1 kOe). Remanent magnetization, $M_r$, is the intrinsic field of the sample when the applied field is zero. $M_r$ of the mechanically milled sample is approximately 35 emu/g, while that of the bulk sample is approximately 25 emu/g. FIG. 9 shows hysteresis loops in a 50 kOe applied field. Magnetic saturation, $M_S$, has not been reached, as evident from the increasing magnetization at high fields. For the mechanically milled sample, the remanence ratio, $M_r/M_S$, is about 0.5 when the applied field is 50 kOe, which is characteristic of materials that are not exchange-coupled.

Figure 10:
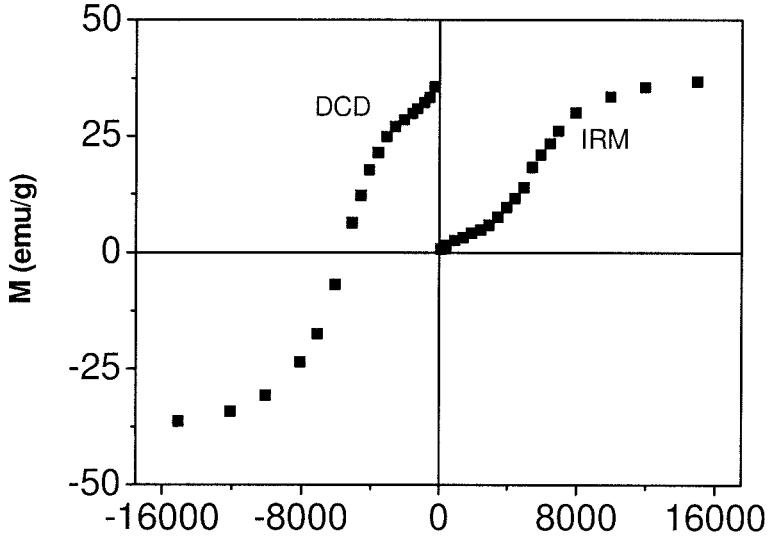
FIG. 10 shows room temperature isothermal remanence magnetization (IRM) and dc demagnetization (DCD) curves for mechanically milled $Mn_{54}Al_{46}$ annealed at 400° C. for ten minutes.
Figure 11:
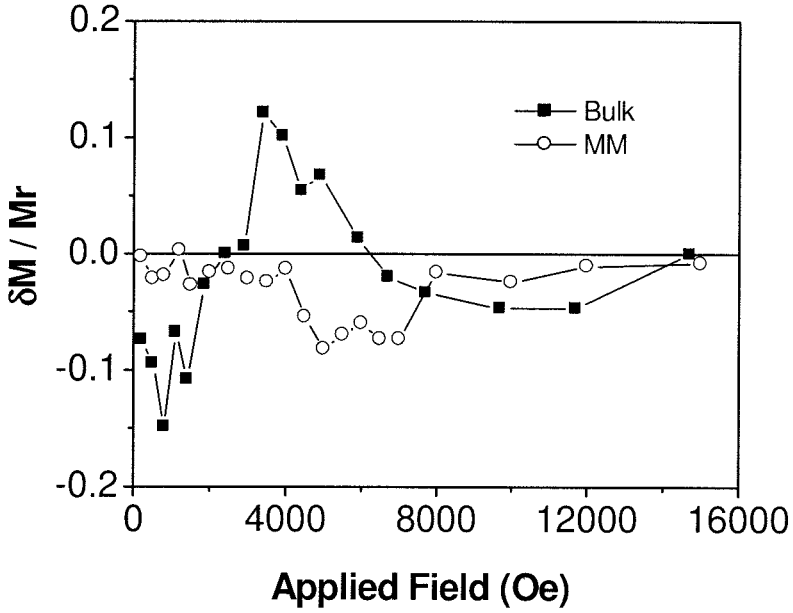
FIG. 11 shows room temperature isothermal remanence magnetization (IRM) difference curves for bulk and mechanically milled $Mn_{54}Al_{46}$ annealed at 400° C. for ten minutes.

FIGS. 10 and 11 show isothermal remanence magnetization (IRM), dc demagnetization (DCD) and difference curves for mechanically milled $Mn_{54}Al_{46}$ annealed at 400° C. for 10 minutes. FIG. 10 shows the IRM and DCD curve for the mechanically milled sample, and FIG. 11 shows the δM curves for both mechanically milled and bulk samples annealed at 400° C. for 10 minutes. Remanence curves and δM plots were used to determine the interaction between the τ phase grains. The DCD curve shows the progress of the irreversible changes in magnetization. The IRM curve contains contributions from both reversible and irreversible magnetization processes. The change of magnetization δM is defined as:

$$\delta M = M_d(H) - [M_r(H_{sat}) - 2M_r(H)] \quad \text{Equation (1)}$$

where $M_d$ (H) is the demagnetic remanent magnetization, $M_r$ is remanent magnetization, and $H_{sat}$ is magnetic field strength that saturates the magnet.

A plot of δM versus H therefore gives a curve characteristic of the interactions present. The overall negative and small δM for the mechanically milled sample indicates that most of the τ phase nanograins are isolated with only small dipolar interactions between them. No exchange coupling exists in this nanostructured material, which explains why the remanence ratio is close to 0.5.

Figure 12:
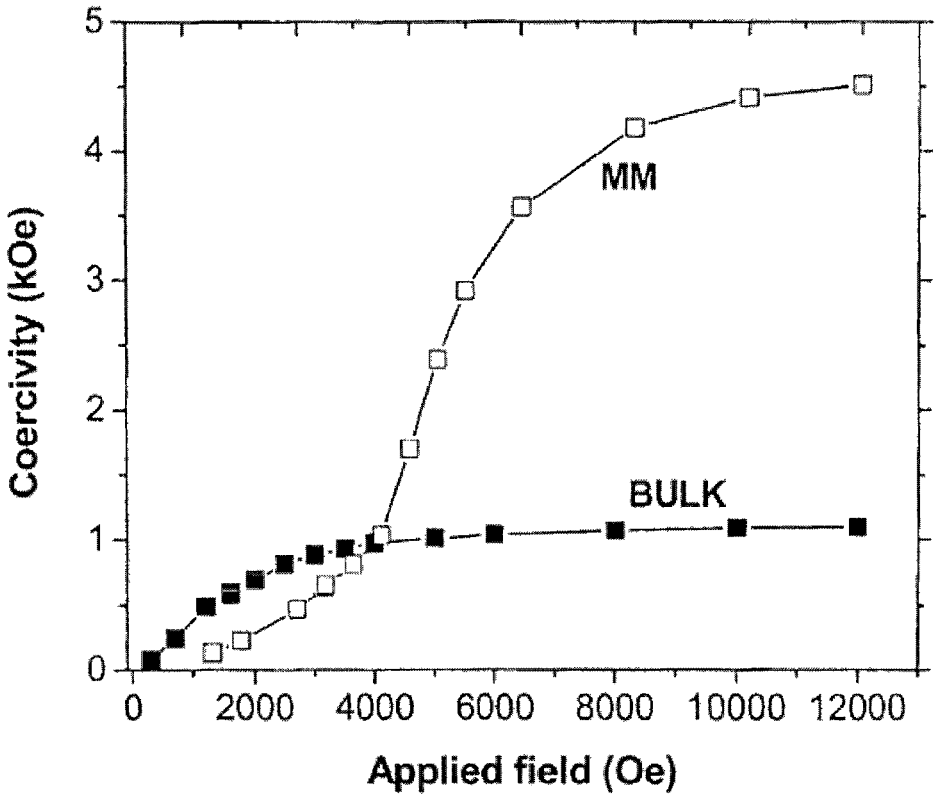
FIG. 12 shows the room temperature dependence of the coercive field on the magnetic field strength for mechanically milled and bulk $Mn_{54}Al_{46}$ powders annealed at 400° C. for ten minutes.

FIG. 12 shows the dependence of the coercive field on the magnetic field strength for mechanically milled and bulk $Mn_{54}Al_{46}$ powders annealed at 400° C. for 10 minutes. The bulk sample curve rises steadily to near saturation. In contrast, the mechanically milled sample curve rises gradually at low fields until the field strength approaches $H_C$ (5 kOe), then it rises quickly to near saturation. This behavior indicates that the mechanism for the magnetization process of the mechanically milled material is controlled by domain wall pinning, and that the applied field gradually removes the domain walls from their pinning sites. The non-magnetic phase(s) that are present could act as the pinning sites.

Alloy Content Sensitivity

Figure 13:
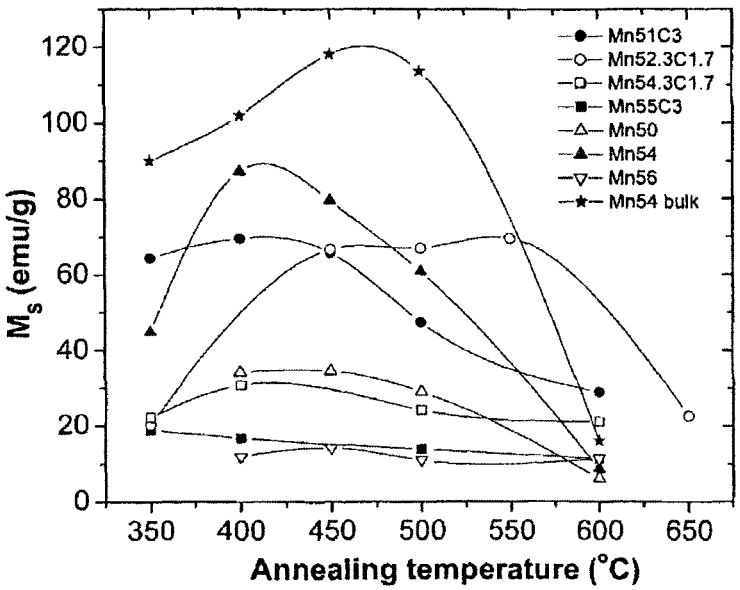
FIG. 13 shows dependence of saturation magnetization on annealing temperatures for mechanically milled and bulk samples of various composition.
Figure 14:
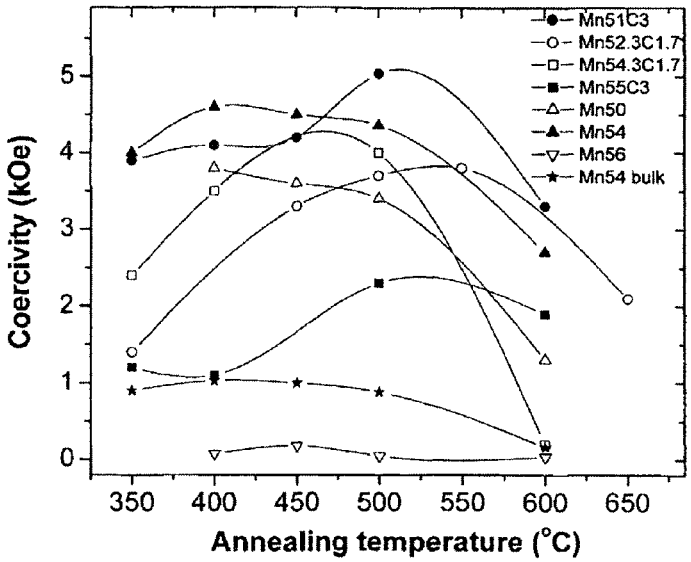
FIG. 14 shows dependence of coercivity on annealing temperatures for mechanically milled and bulk samples of various composition.

The manufacturing process of Example 1 was repeated by varying the content of the Mn and Al metals, and doping with carbon. FIGS. 13 and 14 show the dependence of saturation magnetization and coercivity on annealing temperatures for mechanically milled and bulk samples of various composition after the samples had been annealed for thirty minutes. The legends of FIGS. 13 and 14 show Mn content, and optionally C content, where the remainder of the sample is Al. All samples are mechanically milled, except for those labeled "bulk". It can be seen that 1-3 atomic % carbon decreased $M_S$ but increased $H_C$ in some cases. In particular, $Mn_{51}Al_{46}C_3$ had the highest $H_C$ observed to date for a Mn—Al—C alloy, 5.2 kOe. Dopants other than carbon may include boron and the rare earth metals. Generally, it can be noted that because the τ phase is the only ferromagnetic phase in the Mn—Al or Mn—Al—C systems, the saturation magnetization is proportional to the percentage of the τ phase in the alloys. When the Mn content is 50 atomic percent or less, little ϵ phase can be developed, and therefore only a small amount of τ phase can be produced. Also, when the Mn content is high, excess Mn is used to stabilize the metastable τ phase. In this case, some Mn atoms occupy lattice sites where they are coupled antiferromagnetically to other nearby Mn atoms, thereby reducing the magnetization. Thus, the Mn content is preferably between 52 and 58 atomic percent and the alloys may be described according to Formula (1);

$Mn_XAl_YDo_Z$, where

Do is a dopant that may include carbon and boron,

X ranges from 52-58 atomic %,

Y ranges from 42-48 atomic %, and

Z ranges from 0 to 3 atomic %.

In a more preferred sense:

Do is carbon,

X ranges from 53-56 atomic %,

Y ranges from 44-47 atomic %, and

Z ranges up to 3 atomic %.

In a most preferred embodiment, X is 54, Y is 46, and Do is not necessarily present.

Ternary Transition Metal Modification of τ-MnAl Permanent Magnets $Mn_XAl_YT_Z$ alloy ingots are prepared by arc-melting Mn and Al in a water-cooled copper mold ($T_m$≈1250-1350° C.). At this temperature, the ternary transition metals Fe, Co, and Ni would not be melted and still in solid form. Because the amount of the ternary transition metals is relatively small in the alloy ingots, the transition metals can still be uniformly mixed in the melted solution of Mn and Al. Quenching may be performed by allowing the alloy to rapidly cool in the copper mold to a temperature of about 30° C. in approximately 10 minutes. The ingots may be flipped and melted a minimum of three times under argon to ensure mixing. The ingots may be subsequently heated to and held at 1150° C. for 20 h followed by water quenching to retain the ϵ phase. The ingots are then crushed and milled for eight hours in a hardened steel vial using a SPEX 8000 mill containing hardened steels balls with a ball-to-charge weight ratio of 10:1. The vials may be sealed under argon to limit oxidation. Both the as-milled powders and the quenched bulk samples may be annealed at temperatures from 350-600° C. for 10-30 minutes to produce the ferromagnetic τ phase.

Figure 15:
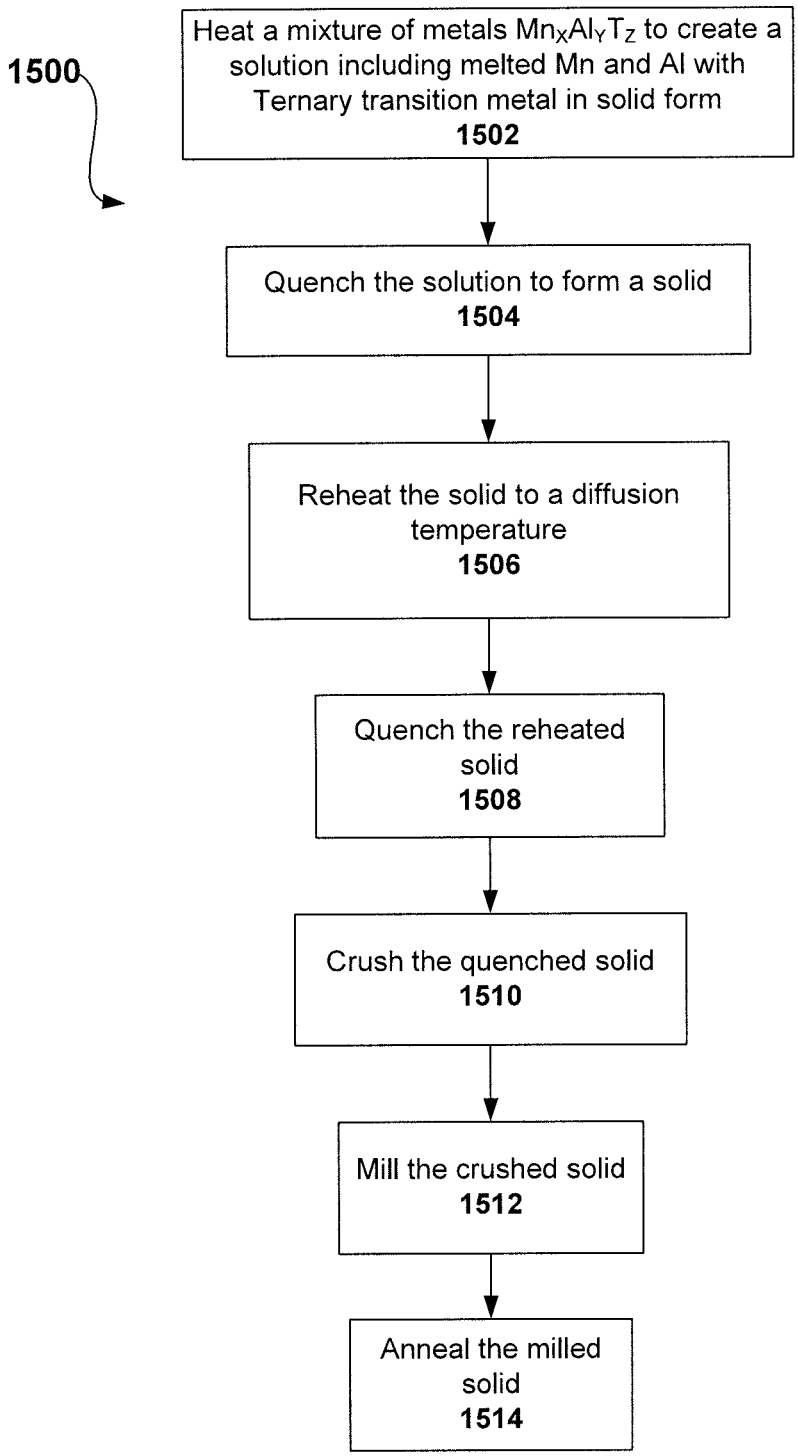
FIG. 15 is a flowchart illustrating a method of producing magnetic alloys with increased $M_s$ according to one embodiment.

FIG. 15 is a flowchart illustrating a method 1500 of producing magnetic alloys with increased saturation magnetization $M_s$ according to one embodiment. In a first step 1502, a mixture of metals $Mn_XAl_YT_Z$, which may be in the form of ingots, powders, ribbons, pellets or the like, is heated to melt manganese and aluminum, but the transition metal T (e.g. Fe, Co, or Ni) is in solid form. In a second step 1504, the liquid solution including melted manganese and aluminum and transition metal in solid form is quenched to form a solid solution. Steps 1502 and 1504 may be repeated to ensure that adequate mixing results in the formation of a substantially homogeneous solution which has a uniform structure or composition throughout, such that in a randomized sampling of the solution at least 95% of the samples would have consistent compositions. In step 1506, the substantially homogeneous solution is reheated to a diffusion temperature that is just below the melting temperature of the manganese, for example at 1150° C. for about 20 hours. The solid solution is held at the diffusion temperature for a period of time that is sufficient for the solid diffusion process to reach completion. For example, the solid solution may be held at the diffusion temperature for twenty hours. In step 1508, the solid solution is quenched, e.g., with water, to halt the diffusion process, and isolate the solid solution without structural rearrangement that would otherwise occur in a slow cooling process to form a quenched solid. In steps 1510 and 1512, the quenched solid is crushed and milled to repeatedly fracture and cold weld the particles in order to form a milled solid which is a nanostructured magnetic alloy. The milling is sufficient to cause a rupture of the crystals of the alloy as well as to allow sufficient interdiffusion between the elementary components. In step 1514, the milled solid is annealed at temperatures from 350 to 600° C. for approximately 10 to 30 minutes to produce the ferromagnetic τ phase and ensure complete formation of the nanostructured magnetic alloy.

Figure 16:
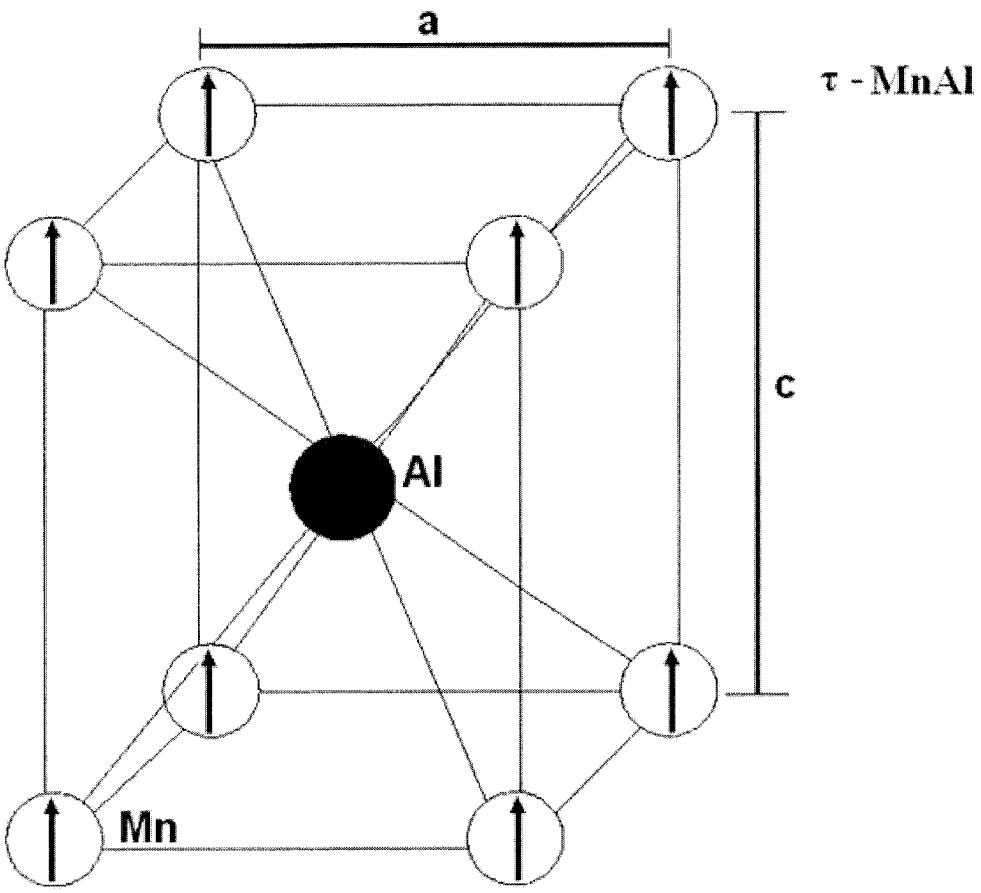
FIG. 16 illustrates a crystal structure of τ phase of MnAl.

While neither Mn nor Al are ferromagnetic, the τ-MnAl phase is strongly ferromagnetic. The ferromagnetism arises because the Mn atoms only interact with each other as second nearest-neighbors and, hence, their magnetic moments are parallel. When Mn atoms are first nearest-neighbors, their magnetic moments are antiparallel and hence cancel each other out. τ-MnAl, which is metastable, is formed via heat treatment of the high temperature hexagonal ϵ phase by either controlled cooling or quenching and annealing as discussed above. FIG. 16 illustrates a crystal structure of τ phase of MnAl. The crystal structure is tetragonal. The c/a ratio is close to 1. The arrows indicate the magnetic dipoles. It is known that Mn metal is ordinarily antiferromagnetic. By increasing the atomic distance between Mn atoms to 2.96 Å or more, the element becomes ferromagnetic. The ferromagnetism of the τ phase in MnAl occurs because the magnetic moments of Mn atoms in 0, 0, 0 sites are parallel to one another.

Figure 17:
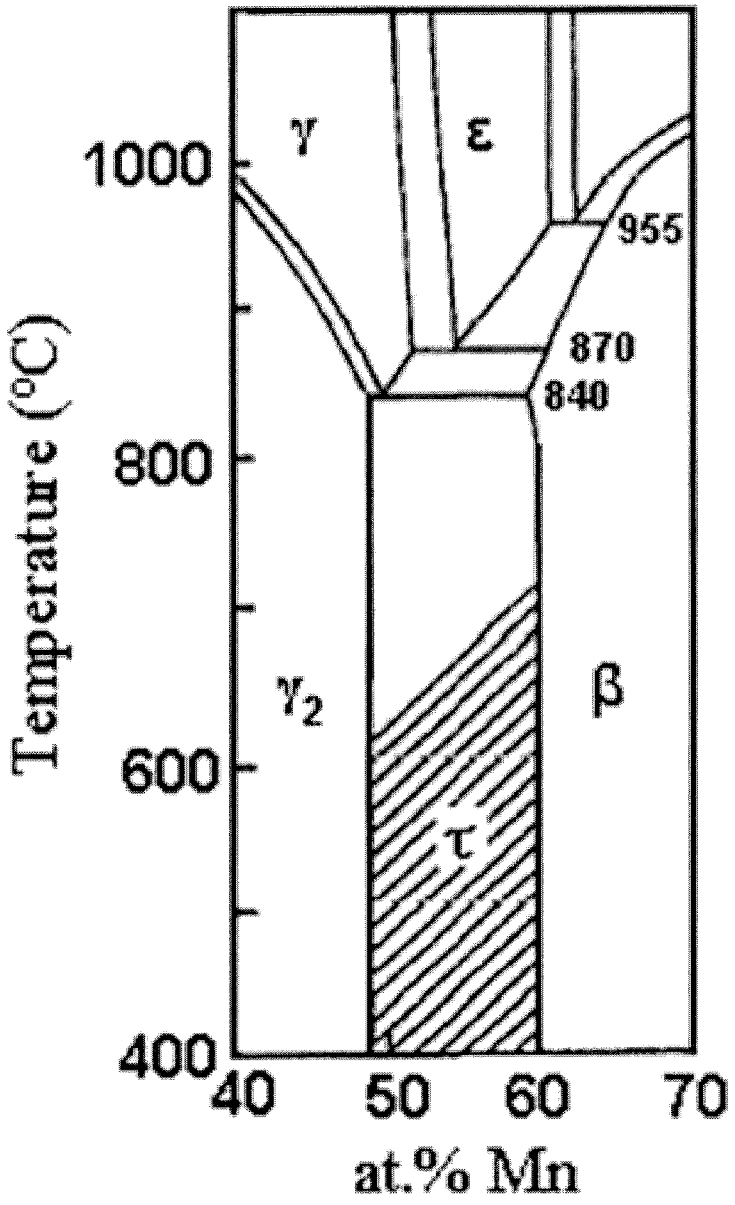
FIG. 17 illustrates a section phase diagram of MnAl.

FIG. 17 illustrates a section phase diagram of MnAl. Note that MnAl has a high temperatures ϵ phase, low temperature equilibrium $\gamma_2$ and β phases, and a metastable τ phase. Although various mechanisms have been proposed for τ phase formation, the generally accepted one is that the high temperature non-magnetic ϵ phase (h.c.p.) transforms into a non-magnetic ϵ' phase (orthorhombic) by an ordering reaction, and then transforms into a ferromagnetic τ phase by a martensitic phase transition, i.e. ϵ→ϵ'→τ. However, the transformation from ϵ to τ may also involve diffusion, and a nucleation and growth process or a massive transformation, as suggested by recent electron microscopy observations and kinetic analysis. The high density of lattice defects within the τ phase that develops during the phase transformation is attributed to growth faults produced during atomic attachment at the migrating interface. Practically, the tetragonal τ phase, which is metastable, is usually produced either by a rapid quenching of the high temperature τ phase followed by isothermal annealing between 400° C. and 700° C., or by cooling the ϵ phase at a rate of about 10° C./min. Prolonged annealing and elevated temperatures result in decomposition of the τ phase into the equilibrium cubic $\gamma_2$ and β phases (see FIG. 17).

Having described several embodiments, it will be recognized by those skilled in the art that various modifications, alternative constructions and equivalents may be used without departing from the spirit of the disclosure. Additionally, a number of well known mathematical derivations and expressions, processes and elements have not been described in order to avoid unnecessarily obscuring the present disclosure. Accordingly, the above description should not be taken as limiting the scope of the disclosure.

It should thus be noted that the matter contained in the above description or shown in the accompanying drawings should be interpreted as illustrative and not in a limiting sense. The following claims are intended to cover generic and specific features described herein, as well as all statements of the scope of the present method and system.

What is claimed is:

1. An intermetallic composition comprising a ternary transition metal modified manganese aluminum alloy comprising a bulk nanostructured alloy with at least about 80% of a magnetic τ phase and having permanent magnetic properties, the bulk alloy having a macroscopic composition of $Mn_XAl_YT_Z$, wherein T is a ternary transition metal selected from a group consisting of iron, cobalt and nickel, X ranges from 50 atomic % to 60 atomic %, X +Y +Z =100 atomic %, and Z is an amount less than 10 atomic % sufficient to impart a saturation magnetization of at least 96 emu/g and the τ phase comprises Mn, Al and a ternary transition metal selected from the group consisting of iron, cobalt and nickel.

2. The intermetallic composition of claim 1, wherein Y ranges from 36-46 atomic %.

3. The intermetallic composition of claim 1, wherein the alloy comprises approximately 54 atomic % manganese, approximately 41 atomic % aluminum, and approximately 5 atomic % ternary transition metal.

4. The intermetallic composition of claim 1, wherein the alloy comprises approximately 54 atomic % manganese, approximately 36 atomic % aluminum, and approximately 10 atomic % ternary transition metal.

5. The intermetallic composition of claim 4, wherein the permanent magnetic properties comprise a saturation magnetization value of at least 105 emu/g.

6. The intermetallic composition of claim 1 wherein the bulk nanostructured alloy further includes γ and β phases.

* * * * *

UNITED STATES PATENT AND TRADEMARK OFFICE

CERTIFICATE OF CORRECTION

PATENT NO. : 8,999,233 B2
APPLICATION NO. : 13/328903
DATED : April 7, 2015
INVENTOR(S) : Ian Baker It is certified that error appears in the above-identified patent and that said Letters Patent is hereby corrected as shown below:

Title Page, Item (57), lines 3-4 of Abstract, "intennetallic" should read -- intermetallic --.

Signed and Sealed this
First Day of December, 2015

Michelle K. Lee

Michelle K. Lee
*Director of the United States Patent and Trademark Office*